US007731839B2

(12) United States Patent
Brown et al.

(10) Patent No.: US 7,731,839 B2
(45) **Date of Patent: *Jun. 8, 2010**

(54) PROCESS FOR REDUCING BROMINE INDEX OF HYDROCARBON FEEDSTOCKS

(75) Inventors: Stephen Harold Brown, Brussels (BE); Gary David Mohr, Houston, TX (US); Michael Christopher Clark, Pasadena, TX (US); Selma Lawrence, Houston, TX (US)

(73) Assignee: Exxonmobil Chemical Patents Inc., Houston, TX (US)

( * ) Notice: Subject to any disclaimer, the term of this patent is extended or adjusted under 35 U.S.C. 154(b) by 517 days.

This patent is subject to a terminal disclaimer.

(21) Appl. No.: 11/140,182

(22) Filed: May 27, 2005

(65) Prior Publication Data

US 2006/0270886 A1 Nov. 30, 2006

(51) Int. Cl.
*C07C 2/02* (2006.01)

(52) U.S. Cl. ..... 208/295; 208/177; 208/307; 585/323; 585/804; 585/809; 585/467

(58) Field of Classification Search ..... None
See application file for complete search history.

(56) References Cited

U.S. PATENT DOCUMENTS

| | | | | |
|---|---|---|---|---|
| 4,795,550 | A | 1/1989 | Sachtler et al. | |
| 4,826,667 | A | 5/1989 | Zones et al. | |
| 5,149,894 | A | 9/1992 | Holtermann et al. | |
| 5,202,014 | A | 4/1993 | Zones et al. | |
| 5,421,992 | A | 6/1995 | Zones et al. | |
| 5,591,322 | A | 1/1997 | Zones et al. | |
| 5,691,463 | A | 11/1997 | Zones et al. | |
| 5,942,650 | A * | 8/1999 | Gajda | 585/448 |
| 6,005,154 | A | 12/1999 | Zones et al. | |
| 6,111,158 | A | 8/2000 | Marinangeli et al. | |
| 6,133,497 | A | 10/2000 | Hähn et al. | |
| 6,323,381 | B1 | 11/2001 | Nacamuli et al. | |
| 6,368,496 | B1 | 4/2002 | Brown et al. | |
| 6,500,996 | B1 | 12/2002 | Brown et al. | |
| 6,525,234 | B1 * | 2/2003 | Dandekar et al. | 585/467 |
| 6,781,023 | B2 | 8/2004 | Brown et al. | |
| 7,176,340 | B2 * | 2/2007 | Van Broekhoven et al. | 585/449 |
| 2006/0020154 | A1 | 1/2006 | Lo et al. | |

FOREIGN PATENT DOCUMENTS

| | | |
|---|---|---|
| CS | 252248 | 8/1987 |

(Continued)

OTHER PUBLICATIONS

U.S. Appl. No. 10/897,528, filed Jul. 23, 2004, Brown et al.

(Continued)

*Primary Examiner*—Tam M Nguyen
(74) *Attorney, Agent, or Firm*—Andrew B. Griffis

(57) ABSTRACT

A process for reducing the Bromine Index of a hydrocarbon feedstock, the process comprising the step of contacting the hydrocarbon feedstock with a catalyst at conversion conditions, wherein the catalyst includes at least one molecular sieve and at least one clay, and wherein said catalyst is sufficient to reduce more than 50% of the Bromine Index of a hydrocarbon feedstock.

4 Claims, 1 Drawing Sheet

FOREIGN PATENT DOCUMENTS

| | | |
|---|---|---|
| EP | 0 432 814 | 6/1991 |
| EP | 0 692 307 | 1/1996 |
| EP | 0 704 416 | 4/1996 |
| JP | 119882 | 5/1996 |
| WO | WO94/00409 | 1/1994 |
| WO | WO96/30119 | 10/1996 |
| WO | WO99/38936 | 8/1999 |

OTHER PUBLICATIONS

Robert A. Meyes, "Handbook of Petroleum Processing", McGraw-Hill, New York 1996, pp. 4.3-4.6.

* cited by examiner

PROCESS FOR REDUCING BROMINE INDEX OF HYDROCARBON FEEDSTOCKS

FIELD

The present invention relates to a process for reducing the Bromine Index (hereafter BI) of hydrocarbon feedstocks such as aromatic hydrocarbon feedstocks. In particular, the present invention relates to a process for selectively reducing bromine-reactive components such as multi-olefins and olefins in the aromatic hydrocarbon feedstocks to provide a substantially purified aromatic hydrocarbon product.

BACKGROUND OF INVENTION

Hydrocarbon feedstocks such as aromatic hydrocarbon feedstocks are derived from processes such as naphtha reforming and thermal cracking (pyrolysis), which can be used as feedstocks in a variety of petrochemical processes, such as para-xylene production from an aromatic hydrocarbon feedstock containing benzene, toluene and xylene (BTX), toluene disproportionation, xylene isomerization, alkylation and transalkylation. However, aromatic hydrocarbon feedstocks often contain contaminants comprising bromine-reactive compounds including unsaturated hydrocarbons, such as mono-olefins, multi-olefins and styrenes, which can cause undesirable side reactions in downstream processes. Therefore, these contaminants should be removed from the aromatic hydrocarbon feedstocks before they can be used in other processes.

Improved processes for aromatics production, such as that described in the Handbook of Petroleum Processing, McGraw-Hill, New York 1996, pp. 4.3-4.26, provide increased aromatics yield but also increase the amount of contaminants. For example, the shift from high-pressure semi-regenerative reformers to low-pressure moving bed reformers results in a substantial increase in BI in the reformate streams, which are aromatic hydrocarbon feedstocks for downstream processes. This results in a greater need for more efficient and less expensive methods for removal of hydrocarbon contaminants from aromatic hydrocarbon feedstocks, e.g., reformate streams.

Olefins (mono-olefins and multi-olefins) in aromatic hydrocarbon feedstocks are commercially removed by hydrotreating processes. Commercial hydrotreating catalysts have proved active and stable to substantially convert multi-olefins contained therein to oligomers and to partially convert the olefins to alkylaromatics.

The clay treatment of hydrocarbons is widely practiced in the petroleum and petrochemical industries. Clay catalysts are used to remove impurities from hydrocarbon feedstocks in a wide variety of processes. One of the most common reasons for treating these hydrocarbon feedstocks with a clay catalyst system is to remove olefinic materials in order to meet various quality specifications. As used herein the term "olefinic compound" or "olefinic material" is intended to refer to both mono-olefins and multi-olefins. Olefinic compounds may be objectionable in aromatic hydrocarbons at even very low concentrations of less than a few parts per million (ppm) for some processes such as nitration of benzene. Undesirable olefins, including both multi-olefins and mono-olefins, have typically been concurrently removed from aromatic hydrocarbon feedstocks by contacting the aromatic hydrocarbon feedstocks with acid-treated clay.

More recently, molecular sieves, and particularly zeolites, have been proposed as replacements for clays in the removal of olefinic compounds from aromatic hydrocarbon feedstocks. U.S. Pat. No. 6,368,496 (Brown et al.) discloses a method for removing bromine-reactive contaminants from an aromatic hydrocarbon stream which comprises providing an aromatic hydrocarbon feedstream which has a negligible multi-olefin level and contacting the feedstream with an acid active catalyst composition under conditions sufficient to remove mono-olefinic bromine-reactive contaminants. The acid active catalyst composition comprises a crystalline molecular sieve material with a pore/channel system.

U.S. Pat. No. 6,500,996 (Brown et al.) discloses a method for the treatment of an aromatics reformate to remove olefins therefrom, the method comprising contacting the reformate with a hydrotreating catalyst to substantially convert multi-olefins contained therein to oligomers and to partially convert the olefins to alkylaromatics, separating at least some of the oligomers from the hydrotreated reformate, and then contacting the hydrotreated reformate with a molecular sieve to convert at least part of the remaining olefins to alkylaromatics. The molecular sieve is selected from the group consisting of ZSM-4, ZSM-12, mordenite, ZSM-18, ZSM-20, zeolite beta, zeolite X, zeolite Y, USY, REY, MCM-22, MCM-36, MCM-49, MCM-56, M41S and MCM-41.

U.S. Pat. No. 6,781,023 (Brown et al.), discloses a method for removing bromine-reactive contaminants from an aromatic hydrocarbon stream. The method comprises: providing an aromatic hydrocarbon feedstream that has a negligible multi-olefin level and contacting the feedstream with an unbound or self-bound acid active catalyst composition comprising self-bound MCM-22 under conditions sufficient to remove mono-olefinic bromine-reactive contaminants.

U.S. Pat. No. 6,781,023 (Brown et al.), discloses a method for the treatment of aromatics reformate to remove olefins therefrom, the method comprising contacting the reformate with a molecular sieve to convert the olefins to alkylaromatics. The molecular sieve is an intermediate pore size zeolite selected from the group consisting of ZSM-4, ZSM-12, mordenite, ZSM-18, ZSM-20, zeolite beta, Faujasite X, Faujasite Y, USY, REY and other forms of X and Y, MCM-22, MCM-36, MCM-49, MCM-56, M41S and MCM-41.

U.S. patent application Ser. No. 10/897,528 (Brown et al.), discloses a method for reducing the BI of a feed having a BI of less than about 50 and containing a linear alkylbenzene and bromine-reactive olefinic hydrocarbon contaminants. The method includes the step of contacting the feed with a catalyst comprising zeolite Y catalyst having an alpha value of about 2 to about 30 under conditions effective to reduce the amount of the bromine-reactive olefinic hydrocarbon contaminants.

Both clays and molecular sieves have limited lifetimes in hydrocarbon feedstock treatment services. The length of service correlates with the amount and the kind of olefinic compounds in the hydrocarbon feedstocks. Indeed, although clay is the less expensive of the two alternatives, it is still a significant expense and it is not uncommon for large petrochemical plants processing 1000 kilo-ton per year (KTA) reformate feed to spend more than $250,000 a year on clay.

The cost of clays and/or molecular sieves has created a need for an efficient and cost-effective method for removing contaminants from hydrocarbon feedstocks such as aromatic hydrocarbon feedstocks. The present invention solves this problem by advantageously using a combination of molecular sieve materials and clay to more efficiently remove contaminants from aromatic hydrocarbon feedstocks while extending the life of the molecular sieve materials and clay.

SUMMARY OF THE INVENTION

In one embodiment, the present invention relates to a process for reducing the Bromine Index of a hydrocarbon feedstock, the process comprising the step of contacting the hydrocarbon feedstock with a catalyst at conversion conditions, wherein the catalyst includes at least one molecular sieve and at least one clay.

In another embodiment of the present invention, a process is provided for reducing the Bromine Index of an aromatic hydrocarbon feedstock, the process comprising the step of contacting the aromatic hydrocarbon feedstock under conversion conditions with a catalyst, wherein the catalyst includes at least one molecular sieve and at least one clay.

In yet another preferred embodiment, this invention relates to a process for reducing the Bromine Index of a hydrocarbon feedstock, comprising the steps of:

(a) retrofitting an existing clay treater with a catalyst includes at least one molecular sieve and at least one clay; and (b) contacting the hydrocarbon feedstock with the catalyst under conversion conditions, wherein a first product has a Bromine Index no greater than 50% of the Bromine Index of the hydrocarbon feedstock, wherein the conversion conditions comprise a temperature range from about 38° C. to about 538° C., a pressure range from about 136 kPa-a to about 13891 kPa-a, and a WHSV from about 0.1 $hr^{-1}$ to about 200 $hr^{-1}$, wherein the catalyst has a volume ratio of the molecular sieve over the clay from about 1:99 to about 99:1, and wherein the hydrocarbon feedstock has a flowrate of at least 10 kg per day.

In another preferred embodiment, this invention relates to a process for reducing olefinic compounds in a hydrocarbon feedstock, comprising the steps of:

(a) contacting the hydrocarbon feedstock with a at least one molecular sieve under first conversion conditions to form a first product, wherein the first product has 50% less olefinic compounds than the hydrocarbon feedstock; and (b) contacting at least a portion of the first product with at least one clay under second conversion conditions to form a second product, wherein the second product has 50% less olefinic compounds the first product, wherein the first and second conversion conditions comprise a temperature range from about 38° C. to about 538° C., a pressure range from about 136 kPa-a to about 13891 kPa-a, and a WHSV from about 0.1 $hr^{-1}$ to about 200 $hr^{-1}$, wherein the catalyst has a volume ratio of the molecular sieve over the clay from about 1:99 to about 99:1, and wherein the hydrocarbon feedstock has a flowrate of at least 10 kg per day.

DETAILED DESCRIPTION OF THE INVENTION

Figure 1:
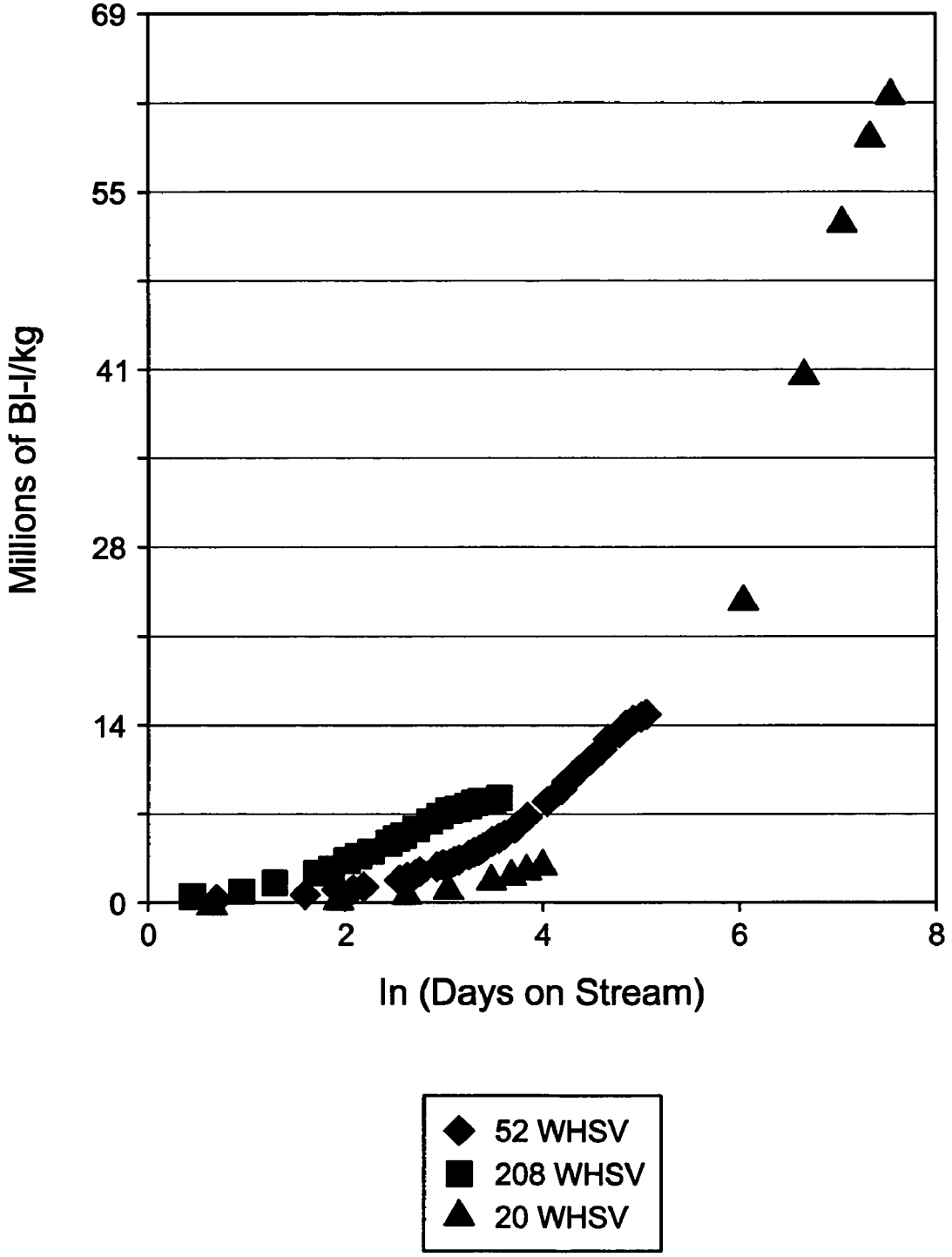
FIG. 1 is a graph showing Bromine Index reduction capacity (Million of BI-Liter/kg) of MCM-22 without binder at different WHSV ($hr^{-1}$) and days on stream (day).

Clay treaters used for the treatment of aromatic hydrocarbon feedstocks are generally operated as swing-bed units. When the clay is spent, the aromatic hydrocarbon feedstocks are directed to a second reactor containing fresh clay, while the first reactor is emptied and reloaded. A molecular sieve system has the advantage of long cycle-length, relative to the use of clay. The major disadvantage of a molecular sieve system is the high price of the molecular sieve materials.

The term "on-oil" or "on-stream" as used herein, means contacting the feedstock(s) with a catalyst in a reactor e.g., molecular sieve(s), clay(s) or any combination thereof, under conversion conditions. The term "on-oil time" used herein, means the total on-oil time, i.e., the total time when the catalyst in a reactor is in contact with the hydrocarbon feedstock(s) under conversion conditions before the unit shutdown for regeneration or rejuvenation of the catalyst in the unit. For example, after contacting a fresh catalyst with a hydrocarbon feedstock for a period of time under catalytic conversion conditions, the unit needs to shutdown for catalyst regeneration.

The term "cycle-length" as used herein means the on-oil time of the clay treater or molecular sieve bed before clay/molecular sieve change-out or regeneration. The cycle-length is a function of the hydrocarbon feedstock composition and deactivation rate of the clay/molecular sieve catalyst. In general, high mono-olefinic and/or multi-olefinic compounds and low clay/molecular sieve bed capacity will have a short cycle-length.

The method of the present invention improves the cycle-length by using a combination of molecular sieve(s) and clay(s) to reduce the amounts of molecular sieves and clays that are used and to extend the life of the molecular sieve(s) and clay(s). While not intending to be limited by any theory, we believe that the clay non-selectively removes olefinic compounds and the molecular sieves selectively removes smaller olefinic compounds. The combined molecular sieve(s) and clay(s) catalyst has the advantage of using molecular sieve(s) to remove selectively most of the small olefinic compounds and using clay(s) to remove non-selectively the residual olefinic compounds (mainly larger olefinic compounds). The combination of molecular sieve(s) and clay(s) catalyst provides a longer cycle-length than the molecular sieve(s) or the clay(s) alone.

Feed

Hydrocarbon feedstocks such as aromatic streams can be obtained from reforming and cracking processes. The hydrocarbon feedstocks include, e.g., paraffins, aromatics, and bromine-reactive compounds such as olefins. For example, aromatic hydrocarbon feedstocks include mononuclear aromatic hydrocarbons and undesirable olefins including mono-olefins, multi-olefins, and styrene, which have an initial BI from about 100 to about 3000.

Because the exact nature of the unsaturated hydrocarbons may vary and may even be unknown, indirect methods of measuring the unsaturated hydrocarbons are typically used. One well-known method of measuring trace amounts of unsaturated hydrocarbons is the BI. The measurement of BI is described in detail in ASTM D2710-92, the entire contents of which are incorporated herein by reference. The BI indirectly measures the olefin content of aromatic containing hydrocarbon samples using potentiometric titration. Specifically, the BI is defined as the number of milligrams of bromine consumed by 100 grams of hydrocarbon sample under given conditions.

The aromatics include, for example, benzene, toluene, xylene, ethylbenzene, cumene and other aromatics derived, e.g., from reformate. Reformate is separated by distillation into light reformate (mostly benzene and toluene), and heavy reformate (including toluene, ortho-, meta- and para-xylenes and other heavier aromatics such as $C_9$+). After extraction, the aromatic feedstream typically contains >98 wt % benzene+toluene. Heavy reformate feedstocks typically contain <0.5 wt % toluene and <250 ppm benzene. Some aromatic streams such as heavy reformate derived from semi-regen and CCR reforming processes contain multi-olefins as they emerge from the processing.

The term "mono-olefins" as used herein means olefinic compounds containing one carbon-carbon double bond per molecule. Examples of mono-olefins are ethylene, propylene, butenes, hexenes, and octenes. The term "multi-olefins" used herein means olefinic compounds containing at least two carbon-carbon double bonds per molecule. Examples of multi-olefins are butadienes, cyclopentadienes, and isoprenes.

The amount of multi-olefins in a hydrocarbon feedstock may vary from less than 10 wt. %, preferably less than 1 wt. %, more preferably less than 500 ppm depending on the source of feedstock and any pre-treatment. Extracted benzenes and heavy reformates typically contain <1000 ppm multi-olefins.

The hydrocarbon feedstocks to be processed according to the invention contain bromine-reactive hydrocarbon compounds from about 0.001 to about 10 wt. %, preferably from about 0.001 to about 1.5 wt. %, more preferably from about 0.005 to about 1.5 wt. % or a BI from about 2 to about 20000, preferably from about 2 to about 3000, more preferably from about 10 to about 3000 or most preferably at least 5.

The hydrocarbon feedstock that are processed according to the invention will have a lower BI than the initial BI of the hydrocarbon feedstock. That is, the BI of the hydrocarbon feedstock is reduced when contacted with at least one molecular sieve and at least one clay in accordance with an embodiment of the invention. In one embodiment the hydrocarbon feedstock processed according to the invention has a BI no greater than 50%, preferably no greater than 20%, more preferably no greater than 10%, of the BI of the hydrocarbon feedstock.

Because the combination of the molecular sieve(s) and clay(s) have longer cycle-length and higher capacity than the clay only or the molecular sieve only system, this invention has the advantage of processing hydrocarbon feedstocks (reducing BI) for longer times between reactor changes, or without a hydrotreating reactor or with a smaller hydrotreating reactor than the clay only or the molecular sieve only system.

The hydrotreating process is a process to substantially convert all multi-olefins to oligomers. The hydrotreating catalyst has a metal component, which can be a single metal from Groups VIA and VIIIA of the Periodic Table, such as nickel, cobalt, chromium, vanadium, molybdenum, tungsten, or a combination of metals such as nickel-molybdenum, cobalt-nickel-molybdenum, cobalt-molybdenum, nickel-tungsten or nickel-tungsten-titanium. A preferred hydrotreating catalyst is a commercial $NiMo/Al_2O_3$ catalyst.

In one embodiment, the present invention has a hydrocarbon feedstock flowrate of at least 10 kg per day, preferably more than at least 100 kg per day, more preferably at least 200 kg per day.

Process Conditions

In accordance with the present invention, the above described hydrocarbon feedstocks may be contacted with the molecular sieve(s) and clay(s) system under suitable conversion conditions to remove multi-olefins and mono-olefins. Examples of these conversion conditions include a temperature of from about 38° C. (100° F.) to about 538° C. (1000° F.), preferably 93° C. (200° F.) to about 371° C. (700° F.), more preferably 93° C. (200° F.) to about 316° C. (600° F.), to a pressure of from about 136 kPa-a (5 psig) to about 13891 kPa-a (2,000 psig), preferably from about 205 kPa-a (15 psig) to about 6996 kPa-a (1000 psig), more preferably from about 205 kPa-a (15 psig) to about 3549 kPa-a (500 psig), a weight hourly space velocity (WHSV) from about 0.1 $hr^{-1}$ and about 200 $hr^{-1}$, preferably from about 1 $hr^{-1}$ and about 100 $hr^{-1}$, more preferably from about 2 $hr^{-1}$ and about 50 $hr^{-1}$. The WHSV is based on the total weight of catalyst, i.e., the total weight of active catalyst plus any binder that is used.

The molecular sieve catalyst and clay catalyst may be located in a single reactor vessel. In one embodiment, the hydrocarbon feedstock contacts the molecular sieve prior to the clay. In another embodiment, the hydrocarbon feedstock contacts the clay prior to the molecular sieve. In yet another embodiment, the clay catalyst and the molecular sieve catalyst are a mixture or are mixed in a reactor and the hydrocarbon feedstock contacts both the clay and the molecular sieve at the same time. In yet another embodiment, the clay catalyst and the molecular sieve catalyst exist in packed multiple layers or multiple beds configuration.

In one embodiment, this invention relates to a process retrofitting existing clay catalyst reactor with a catalyst comprising at least one molecular sieve catalyst and at least one clay catalyst. In another embodiment, this invention relates to a process replacing at least a portion of existing clay catalyst in an existing clay catalyst reactor with a catalyst comprising at least one molecular sieve catalyst and at least one clay catalyst.

The molecular sieve catalyst and clay catalyst may have a volume ratio of the molecular sieve catalyst over the clay catalyst range from about 1:99 to about 99:1, preferably from 10:90 to about 90:10, more preferably from about 25:75 to about 75:25. In another embodiment, the molecular sieve catalyst and clay catalyst may have a volume ratio of the molecular sieve catalyst over the clay catalyst range from about 45:55 to about 55:45.

In yet another embodiment, the molecular sieve catalyst and clay catalyst may also be packed in separate reactors. When the molecular sieve catalyst and clay catalyst are in separate reactors, each reactor can have different operating conditions. The molecular sieve catalytic and clay catalytic treating zones may be of any type and configuration that is effective in achieving the desired degree of BI reduction. It may utilize either upward or downward flow, with downward flow being preferred. The pressure in the molecular sieve and clay catalyst system zones should be sufficient to maintain liquid phase conditions. This will normally be a pressure of about 136 kPa-a (5 psig) to about 13891 kPa-a (2,000 psig). Preferably the pressure is set about 345 kPa (50 psi) higher than the vapor pressure of the hydrocarbons at the inlet temperature of the molecular sieve/clay zone. This temperature is preferably within the range of from about 132° C. (270° F.) to about 246° C. (475° F.). The molecular sieve and clay catalytic conversion may be performed over a broad range of weight hourly space velocities (WHSV). This variable is often set by the desired on-stream life of the molecular sieve and clay and may range from less than 0.5 $hr^{-1}$ to about 100 $hr^{-1}$, preferably from about 0.5 $hr^{-1}$ to about 10 $hr^{-1}$, more preferably from 1.0 $hr^{-1}$ to 4.0 $hr^{-1}$ depending on the hydrocarbon feedstock being treated.

Molecular Sieve Catalyst System

It is contemplated that any porous particulate materials having a pore size appropriate to catalytically removing bromine-reactive compounds can be employed in this process. However, a number of additional requirements related to the specific area of application are imposed on these materials.

For example, the large phase interface available in the pores of the porous particulate material must be accessible and useable. Therefore, the porosity, pore size and pore size distribution in large pores (meso- and macropores) are often of major significance, especially when mass transport affects process performance. The surface properties of the porous particulate material can also be very important for the performance of the material in a given application. The morphology of the porous particulate material (e.g., molecular sieves) can also be another important factor for the performance of the material in this invention. For example, a morphology of small particle size or a morphology of thin layering/plate material can have a large accessible interface. Optionally, the molecular sieve(s) used in this invention has a morphology of small particle size such as an average particle size less than 1 μm, preferably less than 0.1 μm, more preferably less than 0.05 μm or a thin layering/plate morphology having a ratio of the thickness over the average of the other two dimensions less than 0.5, preferably less than 0.1, more preferably less than 0.05, more preferably less than 0.01, more preferably less than 0.005, more preferably less than 0.001.

The reaction for catalytically removing bromine-reactive compounds can be any reaction effectively reducing BI. Examples of these reactions are: polymerization of olefinic compounds, alkylation of paraffins and/or aromatics with olefinic compounds, and saturation and/or hydroxylation of the carbon-carbon double bonds of the olefinic compounds in the hydrocarbon feedstocks.

Mesoporous particulate materials include amorphous metal oxide (non-crystalline) materials, which have mesoporous and, optionally, partially microporous structure. The pore size of the mesoporous particulate material is usually in the range of from about 20 Å to about 500 Å.

Microporous particulate materials include crystalline molecular sieves. Molecular sieves are characterized by the fact that they are microporous particulate materials with pores of a well-defined size ranging discretely from about 2 Å to about 20 Å. Most organic molecules, whether in the gas, liquid, or solid phase, have dimensions that fall within this range at room temperature. Selecting a molecular sieve composition with a suitable and discrete pore size therefore allows separation of specific molecules from a mixture with other molecules of a different size through selective adsorption, hence the name "molecular sieve". Apart from the selective adsorption and selective separation of uncharged molecular sieve particles, the well-defined and discrete pore system of a molecular sieve enables selective ion exchange of charged particles and selective catalysis. In the latter two cases, significant properties other than the micropore structure include, for instance, ion exchange capacity, specific surface area and acidity.

Molecular sieves can be classified into various categories such as by their chemical composition and their structural properties. A group of molecular sieves of commercial interest is the group comprising the zeolites, which are defined as crystalline aluminosilicates. Another group is that of the metal silicates, structurally analogous to zeolites, but for the fact that they are substantially free of aluminum (or contain only very small amounts thereof). Still another group of molecular sieves are AlPO-based molecular sieves which contain framework tetrahedral units of alumina ($AlO_2$) and phosphorous oxide ($PO_2$) and, optionally, silica ($SiO_2$). Examples of such molecular sieves include SAPO, AlPO, MeAPO, MeAPSO, ELAPO, and ELAPSO.

A summary of existing technology, in terms of production, modification and characterization of molecular sieves, is described in the book "Molecular Sieves—Principles of Synthesis and Identification"; (R. Szostak, Blackie Academic & Professional, London, 1998, Second Edition). In addition to molecular sieves, amorphous materials, chiefly silica, aluminum silicate and aluminum oxide, have been used as catalyst supports. A number of long-known techniques, such as spray drying, prilling, pelletizing and extrusion, have been and are being used to produce macrostructures in the form of, for example, spherical particles, extrudates, pellets and tablets of both micropores and other types of porous materials for use in catalysis, adsorption and ion exchange. A summary of these techniques is described in "Catalyst Manufacture," A. B. Stiles and T. A. Koch, Marcel Dekker, New York, 1995.

The term "fresh molecular sieve" as used herein means a molecular sieve that has not been exposed to hydrocarbon feedstocks under conversion conditions for a substantial amount of time such as 24 hours. Examples of fresh molecular sieve are newly synthesized MCM-22 before or after calcination. The term "spent molecular sieve" as used herein, means a molecular sieve been exposed to hydrocarbon feedstocks under conversion conditions. Examples of spent molecular sieves are regenerated or rejuvenated MCM-22 or Faujasite after being exposed to a transalkylation feedstock under transalkylation conditions or an alkylation feedstock under alkylation conditions. Typically, a spent molecular sieve has lower catalytic activity than the corresponding fresh molecular sieve.

Molecular sieves/zeolites useful in the present invention include any of the naturally occurring or synthetic crystalline molecular sieves. Examples of these zeolites include large pore zeolites, intermediate pore size zeolites, and small pore zeolites. These zeolites and their isotypes are described in "Atlas of Zeolite Structure Types", Eds. W. H. Meier, D. H. Olson and Ch. Baerlocher, Elsevier, Fourth Edition, 1996, the contents of which is hereby incorporated by reference. A large pore zeolite generally has a pore size of at least about 7 Å and includes LTL, VFI, MAZ, MEI, FAU, EMT, OFF, *BEA, MTW, MWW, and MOR structure type zeolites (IUPAC Commission of Zeolite Nomenclature). Examples of large pore zeolites include mazzite, offretite, zeolite L, VPI-5, zeolite Y, zeolite X, omega, Beta, ZSM-3, ZSM-4, ZSM-18, ZSM-20, SAPO-37, and MCM-22. An intermediate pore size zeolite generally has a pore size from about 5 Å to about 7 Å and includes, for example, MFI, MEL, MTW, EUO, MTT, MFS, AEL, AFO, HEU, FER, and TON structure type zeolites (IUPAC Commission of Zeolite Nomenclature). Examples of intermediate pore size zeolites include ZSM-5, ZSM-11, ZSM-12, ZSM-22, ZSM-23, ZSM-34, ZSM-35, ZSM-385, ZSM-48, ZSM-50, ZSM-57, silicalite 1, and silicalite 2. A small pore size zeolite has a pore size from about 3 Å to about 5.0 Å and includes, for example, CHA, ERI, KFI, LEV, SOD, and LTA structure type zeolites (IUPAC Commission of Zeolite Nomenclature). Examples of small pore zeolites include ZK-4, ZSM-2, SAPO-34, SAPO-35, ZK-14, SAPO-42, ZK-21, ZK-22, ZK-5, ZK-20, zeolite A, hydroxysodalite, erionite, chabazite, zeolite T, gmelinite, ALPO-17, and clinoptilolite.

The molecular sieve useful for this invention is usually a large pore size zeolite having a silica-to-alumina molar ratio of at least about 2, specifically from about 2 to 100. The silica to alumina ratio is determined by conventional analysis. This ratio is meant to represent, as closely as possible, the molar ratio in the framework of the molecular sieve and to exclude silicon and aluminum in the binder or in cationic or other form within the channels.

The molecular sieves for selectively removing mono-olefinic and multi-olefinic compounds include, e.g., large pore zeolites, particularly MCM-22 type materials, MCM-49, MCM-56, zeolite beta, Faujasite, mesoporous materials including those termed M41S, SAPO's, pillared and/or layered materials.

Preferred catalysts include natural or synthetic crystalline molecular sieves, with ring structures of ten to twelve members or greater. Crystalline molecular sieves useful as catalysts include as non-limiting examples, large pore zeolites ZSM-4 (omega) (U.S. Pat. No. 3,923,639), mordenite, ZSM-18 (U.S. Pat. No. 3,950,496), ZSM-20 (U.S. Pat. No. 3,972,983), zeolite Beta (U.S. Pat. Nos. 3,308,069 and Re 28,341), Faujasite X (U.S. Pat. No. 2,882,244), Faujasite Y (U.S. Pat. No. 3,130,007), USY (U.S. Pat. Nos. 3,293,192 and 3,449,070), REY and other forms of X and Y, MCM-22 (U.S. Pat. No. 4,954,325), MCM-36 (U.S. Pat. No. 5,229,341), MCM-49 (U.S. Pat. No. 5,236,575), MCM-56 (U.S. Pat. No. 5,362,697) and mesoporous materials such as M41S (U.S. Pat. No. 5,102,643) and MCM-41 (U.S. Pat. No. 5,098,684). More preferred molecular sieves include 12 membered oxygen-ring structures ZSM-12, mordenite, Zeolite Beta, USY, and the mixed 10-12 membered oxygen ring structures from the MCM-22 family, layered materials and mesoporous materials. Most preferred are the MCM-22 family of molecular sieves, which includes, MCM-22, MCM-36, MCM-49 and MCM-56. The MCM-22 type materials may be considered to contain a similar common layered structure unit. The structure unit is described in U.S. Pat. Nos. 5,371,310, 5,453,554, 5,493,065 and 5,557,024. Each of the patents in this paragraph describing molecular sieve materials is herein incorporated by reference.

One measure of the acid activity of a zeolite is the Alpha Value. The Alpha Value is an approximate indication of the catalyst acid activity and it gives the relative rate constant (rate of normal hexane conversion per volume of catalyst per unit time). It is based on the activity of the highly active silica-alumina cracking catalyst taken as an Alpha of 1 (Rate Constant=0.16 $sec^{-1}$). The alpha test is described in U.S. Pat. No. 3,354,078, in the Journal of Catalysis, Vol. 4, p. 527 (1965); Vol. 6, p. 278, and Vol.; 61, p. 395 (1980), each of which is herein incorporated by reference as to that description. The experimental conditions of the test used include a constant temperature of 538° C., and a variable flow rate as described in the Journal of Catalysis, Vol. 61, p. 395 (1980).

In one embodiment, the molecular sieve(s) has an Alpha Value at least 1, preferably at least 10, more preferably at least 100, more preferably at least 300.

The crystalline molecular sieve may be used in bound form, that is, composited with a matrix material, including synthetic and naturally occurring substances, such as clay, silica, alumina, zirconia, titania, silica-alumina and other metal oxides. Other porous matrix materials include silica-magnesia, silica-zirconia, silica-thoria, silica-beryllia, silica-titania, as well as ternary compositions such as silica-alumina-thoria, silica-alumina-zirconia, silica-alumina-magnesia, and silica-alumina-zirconia. The catalyst can be used in the form of an extrudate, lobed form (e.g., trilobe), or powder.

Clay Catalyst System

The term "clay" as used herein means an aggregate of hydrous silicate particles, preferably less than 4 micrometers in diameter. It consists of small crystals of the minerals silica ($SiO_2$) and alumina ($Al_2O_3$), which is substantially free of the type of the porosity of a molecular sieve. The clay catalyst useful for this application is usually an acidic naturally-occurring clay or a synthetic clay material. Naturally-occurring clays include those of the montmorillonite, kaolin families, bauxite or mordenite clay. Clay catalyst system is used herein to refer to the passage of a hydrocarbon stream through a fixed bed of clay material, which possesses the capability of reacting olefinic compounds present in the hydrocarbon stream. Preferably the contact material is an acidic aluminosilicate. A preferred clay is F-24 clay produced by Engelhard Corporation. However, several other types of clay are available commercially and are suitable for use in the present invention, including Filtrol 24, Filtrol 25 and Filtrol 62 produced by the Filtrol Corporation, Attapulgus clay and Tonsil clay. In a preferred embodiment, the clays are pretreated with concentrated HCl or $H_2SO_4$ acid. The clay used in this invention may formulated by a number of well-known techniques, such as spray drying, prilling, pelletizing and extrusion, to produce a clay catalyst in the form of, for example, spherical particles, extrudates, pellets and tablets.

As previously discussed, clay catalyst system is now conducted over a wide temperature range of from about 93° C. (200° F.) to about 371° C. (700° F.). The conditions utilized in the clay catalyst system are dependent on the hydrocarbon feedstocks and the kind of the clay catalyst used.

Depending on the hydrocarbon feedstock and the operating conditions, two or more separate clay treater vessels can be used on an alternating (i.e., swing) basis to provide continuous operation. A clay reactor can also be used as the swing reactor for the molecular sieve bed when the molecular sieve is being replaced or regenerated.

The molecular sieve and/or clay may be regenerated under regeneration conditions. In one embodiment of the present invention, the molecular sieve and/or clay is regenerated under regenerating conditions comprising a temperature range of about 30 to 900° C., a pressure range of about 10 to 20000 kPa-a, and a WHSV from about 0.1 $hr^{-1}$ to about 1000 $hr^{-1}$, wherein the regenerating conditions comprise a feed having an oxidative reagent such as air, oxygen, and nitrogen oxides.

The molecular sieve and/or clay may be rejuvenated under rejuvenation conditions. In another embodiment of the present invention, the molecular sieve and/or clay is rejuvenated under rejuvenating conditions comprising a temperature range of about 30° C. to about 900° C., a pressure range of about 10 to 20000 kPa-a, and a WHSV from about 0.1 $hr^{-1}$ to about 1000 $hr^{-1}$, wherein the rejuvenating conditions comprise a feed having a reductive reagent, such as hydrogen, $He/H_2$, or $N_2/H_2$.

Feed Pretreatment

The hydrocarbon feedstocks, including aromatic feedstocks, that may be treated by the process of the present invention may contain nitrogen-containing or sulfur-containing impurities that may reduce the cycle length of the molecular sieves catalyst used in such process. These impurities may be at least partially removed by one or more pretreatment steps prior to contacting the hydrocarbon feedstock with the molecular sieve catalyst system of the present invention. In one embodiment, the hydrocarbon feedstock is first pretreated and then contacted with the molecular sieve catalyst system and, optionally contacted with the clay catalyst system in accordance with the present invention.

Such pretreatment steps include, but are not limited to, absorption processes in which the hydrocarbon feedstock is contacted with an absorbent under absorption conditions effective to remove at least a portion of such nitrogen-containing or sulfur-containing impurities. Preferably, the absorbent comprises one or more clay materials, including the clay materials previously described herein or an alumina compound $Al_2O_3$, such as Selexsor® CD That may be obtained from Almatis AC, Inc. Preferably, the absorption conditions includes a temperature of from ambient to 500° C., more preferably from ambient to 200° C. or most preferably from ambient to 100° C.; a pressure sufficient to maintain liquid phase conditions; a weight hourly space velocity from 0.5 $hr^{-1}$ to about 100 $hr^{-1}$, more preferably from about 0.5 $hr^{-1}$ to about 10 $hr^{-1}$, most preferably from 1.0 $hr^{-1}$ to 4.0 $hr^{-1}$ depending on the hydrocarbon feedstock being treated.

The following examples illustrate exemplary preferred embodiments:

Three hydrocarbon feedstocks having different level of olefinic compounds were used in the following examples. These feedstocks were analyzed using standard gas chromatograph ("GC") analysis and the ASTM BI test. The multi-olefins (mainly dienes) in this invention, were analyzed as follows: 0.50 gm of maleic anhydride (Sigma-Aldrich Corporation, Milwaukee, Wis., USA) was added to in a round bottom flask containing 300 gm of the hydrocarbon feedstock. The flask was equipped with a condenser, placed in a heating mantle, and brought to reflux. After 20 hrs the flask was cooled to room temperature. The entire contents of the flask were concentrated using a rotary evaporator at 75° C. and a pressure below 0.67 kPa-a. A white crystalline product was obtained, weighed, and analyzed by NMR in the manner described by L. B. Alemany and S. H. Brown, Energy and Fuels, 1995, 9:257-268. The NMR showed the product to be largely maleic anhydride/diene adducts. The multi-olefins content of a hydrocarbon feedstock was calculated based on the corresponding multi-olefins weight in the white crystalline product over the total weight of the hydrocarbon feedstock under analysis, i.e., 300 grams. The compositions of these feedstocks are listed in Table 1.

TABLE 1

| Hydrocarbon Feedstock | Feed A | Feed B | Feed C |
|---|---|---|---|
| BI | 150-300 | 600-1600 | 550 |
| Total olefinic compounds (ppm | 600-1200 | 3000-8000 | 2700 |
| Mono-olefinic compounds ppm | 300-800 | 3000-8000 | 2700 |
| Multi-olefinic compounds ppm | 200-600 | <200 | <150 |
| Total paraffins (wt. %) | 1-2 | 0.2-0.6 | 1 |
| Total aromatics (wt. %) | 98-99 | 98-99 | 98 |
| Others (wt. %) | <0.2 | 0.75-1.5 | 1 |

Example 1

A feed A was treated with a catalyst having 50 vol. % MCM-22 catalyst and 50 vol. % F-24 clay at temperature of 200° C., WHSV 1 $hr^{-1}$, and pressure 1480 kPa-a (200 psig). The operating temperature was raised to 205° C. during the test for the purpose of maintaining unit BI removal activity. The cycle-length was 170 days to maintain a product BI specification of less than 10.

Example 2

A feed A was treated with a catalyst having 100 vol. % F-24 clay catalyst at conditions identical to Example 1. The operating temperature was raised to 205° C. during the test for the purpose of maintaining unit BI removal activity. The cycle-length was 35 days to maintain a product BI specification of less than 10.

Examples 1 and 2 show that 50 vol. % MCM-22/50 vol. % F-24 clay is 5 times more stable than 100 vol. % clay Example 3

A feed B was treated with a catalyst having 50 vol. % MCM-22 catalyst and 50 vol. % F-24 clay at temperature of 190° C., WHSV 1 $hr^{-1}$, and pressure of 1480 kPa-a (200 psig). The temperature was raised to 195° C. after two months on-oil and further raised to 200° C. after six months on oil. After 13 months on oil the product BI remained between 80 and 150 at 200° C. The projected cycle-length was more than 800 days.

Example 4

A feed B was treated with a catalyst having 100 vol. % F-24 clay at temperature of 165° C., WHSV 1 $hr^{-1}$, and pressure of 1480 kPa-a (200 psig). The clay aged steadily requiring increasing reactor temperature to keep the product BI below the specification of 300. The cycle-length was 70 days at a maximum reactor temperature was 210° C.

Examples 3 and 4 show that the cycle-length of 50 vol, % MCM-22/50 vol. % F-24 clay is more than ten times longer than the cycle-length of 100 vol. % clay.

Examples 5-7

A feed C was treated with a MCM-22 catalyst at a temperature of 205° C., a pressure of 2170 kPa-a (300 psig), and WHSV 20 (Example 5), 52 (Example 6), and 208 (Example 7). The total BI reduction capacity of the MCM-22 catalyst was calculated by multiplying the BI difference between the hydrocarbon feedstock and the product with the total volume of hydrocarbon feedstock processed divided by the total volume of the catalyst used. The results shown unexpectedly high BI reduction capacity at low WHSV (FIG. 1).

The results of examples 5-7 indicate that there is an incentive to operate MCM-22 catalyst for reducing BI of a hydrocarbon feedstock at low WHSV.

All patents, patent applications, test procedures, priority documents, articles, publications, manuals, and other documents cited herein area fully incorporated by reference to the extent such disclosure is not inconsistent with the present invention and for all jurisdictions in which such incorporation is permitted.

When numerical lower limits and numerical upper limits are listed herein, ranges from any lower limit to any upper limit are contemplated.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

What we claim is:

1. A process for reducing the Bromine Index of an aromatic hydrocarbon feedstock having a BI of between 600 and 1600, comprising the step of contacting said hydrocarbon feedstock with a catalyst at conversion conditions to produce a product having a BI of less than 150, said catalyst comprising a molecular sieve structure type of MWW and at least one clay in a single reactor, wherein the volume ratio of said molecular sieve to clay is from about 45:55 to about 55:45," said catalyst having a longer cycle length than the molecular sieve or the clay alone, said cycle length being more than 800 days at a temperature of about 200° C.

2. The process of claim 1, wherein said contacting is for more than 800 days.

3. The process of claim 1, wherein said feedstock comprises less than 0.5 wt % toluene and less than 200 ppm benzene.

4. The process of claim 3, wherein said contacting is for more than 800 days.

* * * * *